US008107836B2

(12) United States Patent
Nishimura

(10) Patent No.: US 8,107,836 B2
(45) Date of Patent: Jan. 31, 2012

(54) IMAGE FORMING APPARATUS HAVING DENSITY DETECTING UNIT FOR DETECTING DENSITY OF PATCH

(75) Inventor: Yoh Nishimura, Nagoya (JP)

(73) Assignee: Brother Kogyo Kabushiki Kaisha, Nagoya-shi, Aichi (JP)

( * ) Notice: Subject to any disclaimer, the term of this patent is extended or adjusted under 35 U.S.C. 154(b) by 362 days.

(21) Appl. No.: 12/371,683

(22) Filed: Feb. 16, 2009

(65) Prior Publication Data

US 2009/0220262 A1 Sep. 3, 2009

(30) Foreign Application Priority Data

Feb. 28, 2008 (JP) ..... 2008-048032

(51) Int. Cl.
*G03G 15/00* (2006.01)

(52) U.S. Cl. ..... 399/49; 399/72

(58) Field of Classification Search ..... 399/38, 399/49, 53, 72

See application file for complete search history.

(56) References Cited

U.S. PATENT DOCUMENTS 4,870,460 A 9/1989 Harada et al.
5,737,665 A * 4/1998 Sugiyama et al. ..... 399/49 X
5,822,079 A 10/1998 Okuno et al.
6,081,678 A * 6/2000 Kato ..... 399/49
7,305,195 B2 * 12/2007 Ishibashi ..... 399/49

FOREIGN PATENT DOCUMENTS

JP 63-142370 6/1988
JP 03-119371 5/1991
JP 08-251364 9/1996

* cited by examiner

*Primary Examiner* — Sandra Brase

(74) *Attorney, Agent, or Firm* — Banner & Witcoff, Ltd.

(57) ABSTRACT

An image forming apparatus includes a plurality of image forming units, a patch forming unit which actuates the respective image forming units to form density detection patches of the respective colors, a density detecting unit that detects a density of the density detecting patches, a condition correcting unit that controls the density detecting unit to detect the density of the density detecting patches of the respective colors, and corrects the image forming conditions based on respective deviations, a patch re-forming unit that, for each color for which the respective deviation is greater than a threshold value, generates a re-formed density detecting patch of the color using the respective image forming condition previously corrected by the condition correcting unit, and a condition re-correcting unit that controls the density detecting unit to detect a density of the re-formed density detecting patch and re-correct the respective image forming condition.

9 Claims, 5 Drawing Sheets

IMAGE FORMING APPARATUS HAVING DENSITY DETECTING UNIT FOR DETECTING DENSITY OF PATCH

CROSS-REFERENCE TO RELATED APPLICATIONS

This application claims priority from Japanese Patent Application No. 2008-048032 filed on Feb. 28, 2008, the entire subject matter of which is incorporated herein by reference.

TECHNICAL FIELD

The present invention relates to an image forming apparatus.

BACKGROUND

An image forming apparatus of an electrophotographic system includes a developing roller opposite to a photosensitive drum. An electrostatic latent image is formed on the surface of the photosensitive drum by uniformly electrifying a surface of the photosensitive drum and selectively eliminating the electric charge accumulated on the surface of the photosensitive drum by exposure. A developing bias is applied to the developing roller, and as the electrostatic latent image is opposed to the developing roller inline with rotation of the photosensitive drum, toner is supplied to the electrostatic latent image from the developing roller based on potential differences between the electrostatic latent image and the developing roller. Therefore, a toner image is formed on the surface of the photosensitive drum. The toner image is then transferred from the surface of the photosensitive drum onto a sheet, and fixed on the sheet by heating or compression.

The toner carried on the developing roller deteriorates as toner images are repeatedly formed, and electric charge remains on the surface of the photosensitive drum after the toner images are formed on the sheet. The deterioration in toner and the small amount of charge remaining affect the development bias and accordingly the density of the toner image such that the density of the toner image transferred to a sheet deviates from an appropriate density. Thus, Japanese Patent No. 2532073 describes a related art image forming apparatus, which is configured to carry out a process for correcting the developing bias so that a toner image of an appropriate density is formed whenever an action of forming a toner image is carried out a given number of times.

SUMMARY

Illustrative aspects of the invention provide an image forming apparatus, which forms an image using a plurality of colors of developers, and which can decrease the time and the amount of developer used for correction of image forming conditions.

DETAILED DESCRIPTION

<General Overview>

The related art image forming apparatuses described above have some disadvantages. For example, in order to correct the developing bias, there has been proposed a related art method of forming toner images called "patches" on the surface of a conveyor belt and correcting the developing bias based on a deviation between the density of the patches and a target density. However, with this method, if the deviation between the patch density and the target density is large, there may be cases where the developing bias is not corrected so as to become an appropriate value at which a toner image of the target density can be formed.

Figure 6:
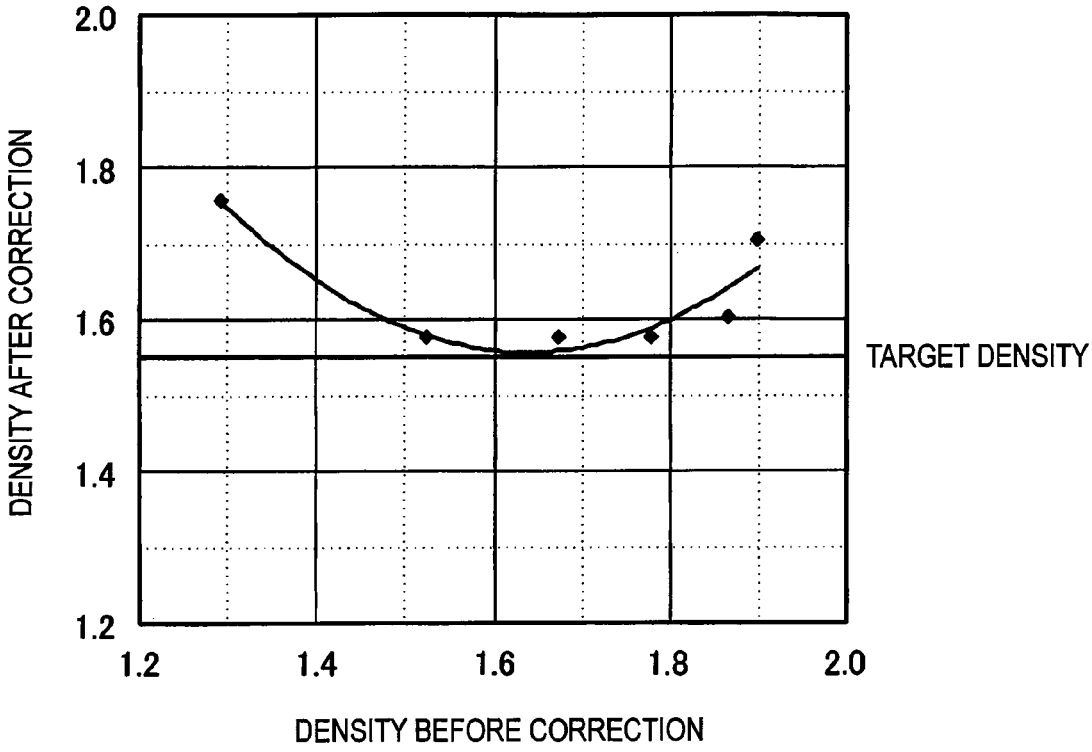
FIG. 6 is a graph showing a relationship between a density of a patch formed by a pre-correction development bias and a density of a patch formed by a post-correction development bias.

For example, FIG. 6 is a graph showing the results of correction of developing bias in a certain related art image forming apparatus. The horizontal axis shows the density before executing correction, and the vertical axis shows the density after executing correction. The values are transmission density values measured by a transmission densitometer. The post-correction densities become curved as shown in the drawing with respect to the pre-correction densities (see line drawn through data points). Also, a thick line in the drawing shows target densities that are the target densities after correction. In this graph, the target density is 1.55. As shown in FIG. 6, the patch density is 1.9 which is widely deviated from the 1.55 target density. Since the deviation between the patch density and the target density is large, the toner image density is only correctable to 1.7. Thus, after correction, a toner image the density of which is 1.7 can be formed with the post-correction developing bias based on this deviation. Thus, the related art image forming apparatuses have a disadvantage in that where the developing bias cannot be corrected to an appropriate value by a single process, it is necessary to repeat the process multiple times in order that the developing bias can be made to converge to an appropriate value.

Moreover, in an image forming apparatus of an electrophotographic system, there is a so-called tandem type color image forming apparatus in which photosensitive drums corresponding to respective colors of yellow, magenta, cyan and black are arranged in a row. In the tandem type color image forming apparatus, toner images of respective corresponding colors are formed on respective photosensitive drums, and toner images of respective colors are overlapped and transferred on a sheet conveyed by a conveyor belt, thereby forming a color image on the sheet. In the case of a tandem-type color image forming apparatus, if the toner images of respective colors are formed with incorrect densities, the hue or color tone of the color image obtained by overlapping the toner images of respective colors on a sheet will become incorrect and appear distorted. Accordingly, the related art image forming apparatus has another disadvantage in that in order to obtain high quality color images, the above-described patch process must be carried out to correct the developing bias for each of the colors.

Additionally, where the developing bias cannot be corrected to an appropriate value by a single process, there is an additional disadvantage in that if the patch process is repeated for each of the colors, it takes much time for correction of the developing bias and toner is uselessly consumed by repeatedly forming patches.

The exemplary embodiments of the present invention described below address the above disadvantages and other disadvantages not described above. However, the present invention is not required to overcome the disadvantages described above, and thus, an exemplary embodiment of the present invention may not overcome any of the problems described above.

Illustrative aspects of the invention provide an image forming apparatus, which forms an image using a plurality of colors of developers, and which can decrease the time and the amount of developers used for correction of image forming conditions.

According to a first illustrative aspect of the invention, there is provided an image forming apparatus comprising: a plurality of image forming units, one image forming unit being provided for each of a plurality of colors, and forming an image of the respective corresponding color; a patch forming unit, which actuates the respective image forming units according to image forming conditions for the respective colors of the image forming units to form density detection patches of the respective colors; a density detecting unit that detects a density of the density detecting patches; a condition correcting unit that controls the density detecting unit to detect the density of the density detecting patches of the respective colors, and corrects the image forming conditions based on respective deviations between the detected densities of the density detecting patches of the respective colors and target densities defined for each of the colors; a patch re-forming unit that, for each color for which the respective deviation is greater than a threshold value, actuates the image forming unit corresponding to the color so as to generate a re-formed density detecting patch of the color using the respective image forming condition previously corrected by the condition correcting unit; and a condition re-correcting unit that is configured to control the density detecting unit to detect a density of the re-formed density detecting patch and re-correct the respective image forming condition of the color of the re-formed density detecting patch based on a deviation between the density of the re-formed density detecting patch and the target density of the color corresponding to the re-formed density detecting patch.

According to a second illustrative aspect of the invention, the image forming apparatus further comprises: a preparation process unit that executes a preparation process to prepare for detection of the density by the density detecting unit before the density detecting patch is formed by the patch forming unit; and a preparation process re-executing unit that re-executes the preparation process before the re-formed density detecting patch is generated by the patch re-forming unit.

According to a third illustrative aspect of the invention, the image forming apparatus further comprises: a cleaning unit that cleans the density detecting patch formed by the patch forming unit, wherein the preparation process re-executing unit executes the preparation process at a same time that the density detecting patch is cleaned by the cleaning unit.

According to a fourth illustrative aspect of the invention, the image forming apparatus further comprises: a base member, on which the density detecting patches are formed, wherein the density detecting unit comprises: a light emitting element; and a light receiving element that receives light, which is emitted from the light emitting element and is reflected from a surface of the density detecting patch or a surface of the base member, and wherein the preparation process comprises: receiving the light reflected from the surface of the density detecting patch or the surface of the base member by the light receiving element; and detecting an amount of the received light.

According to a fifth illustrative aspect of the invention, in the image forming apparatus, wherein the preparation process further comprises: a light amount adjustment process comprising adjusting an amount of the light emitted from the light emitting element so that the amount of the detected light becomes constant.

According to a sixth illustrative aspect of the invention, in the image forming apparatus, wherein the patch forming unit forms the density detecting patches of the respective colors in a straight line with a fixed pitch while being arranged in a given order, and wherein the patch re-forming unit generates the re-formed density detecting patches in a straight line with a fixed pitch while being arranged in the given order.

According to a seventh illustrative aspect of the invention, in the image forming apparatus, wherein each of the image forming units comprises: an image carrier on which an electrostatic latent image is formed; and a developing member, to which development bias is applied, and which supplies developer to the image carrier according to the development bias, and wherein the image forming condition of the respective image forming unit is the development bias.

According to an eighth illustrative aspect of the invention, there is provided an image forming apparatus comprising: a plurality of image forming units, each of which forms an image in a respective one of a plurality of colors; a density sensor; a patch forming unit, which individually controls each of the image forming units according to an image forming condition associated with the respective color of the respective image forming unit to form a patch of the respective color; a condition setting unit that controls the density sensor to detect the density of a patch, calculates a deviation between the detected density of the patch and a target density defined for the respective color, and corrects the image forming condition associated with the color of the patch based on the calculated deviation; a controller that controls the patch forming unit to generate a patch for each of the plurality of colors and controls the condition setting unit to detect the densities of the respective patches, calculate the respective deviations, and to correct the respective image forming conditions associated with each of the plurality of colors, and for each color for which the respective deviation is greater than a threshold value associated with the respective color, controls the patch forming unit to regenerate the patch for the color using the corrected image forming condition, and controls the condition setting unit to detect the density of the regenerated patch, recalculate the deviation, and re-correct the image forming condition associated with the color of the regenerated patch.

According to a ninth illustrative aspect of the invention, in the image forming apparatus, wherein the patch forming unit generates the patches for each of the plurality of colors in a straight line with a fixed pitch while being arranged in a given order.

According to a tenth illustrative aspect of the invention, the image forming apparatus further comprises a conveyor belt, on which the patches are formed.

According to an eleventh illustrative aspect of the invention, there is provided a method for adjusting color densities in an image forming apparatus comprising a density sensor and a plurality of image forming units, each image forming unit being associated with a respective one of a plurality of colors, the method comprising: individually controlling each of the image forming units according to an image forming condition associated with the respective color of the respective image forming unit to form a patch of each of the plurality of colors; detecting a density of each of the patches; calculating a deviation between the detected density of each of the patches and a target density defined for the respective color; correcting the respective image forming conditions associated with each of the plurality of colors based on the calculated deviations; comparing the respective deviation for each color with a threshold deviation associated with the color, and for each color for which the respective deviation is greater than the threshold deviation, regenerating the patch for the color using the corrected image forming condition; detecting a density of the regenerated patch; calculating a second deviation between the density of the regenerated patch and the target density associated with the color; and re-correcting the image forming condition associated with the color based on the calculated second deviation.

According to the illustrative aspects of the invention, density detecting patches for respective colors are formed under image forming conditions of respective colors by the image forming unit for respective colors. Then, the densities of the density detecting patches of respective colors are detected by the density detecting unit. The image forming conditions of respective colors are corrected based on respective deviations between the respective detected densities and the target densities defined for each of the colors. Where there exists a color the deviation of which is greater than a threshold value, a density detecting patch is re-formed under the post-correction image forming conditions by the image forming unit for the color. Then, the density of the re-formed density detecting patch is detected by the density detecting unit. The image forming condition of the color of the density detecting patch is re-corrected based on the deviation between the detected density and the target density.

For example, where density detecting patches of respective colors of black, yellow, magenta and cyan are formed, and the deviations between the densities of the density detecting patches of the two colors thereof and the target values thereof are greater than the threshold values, density detecting patches are re-formed only for the two colors, and the image forming condition is re-corrected based on the deviations between the densities of the corresponding density detecting patches and the target values.

Thus, in a configuration capable of forming an image by a plurality of developers, the image forming conditions of all the colors are not repeatedly corrected, but the image forming conditions are re-corrected only for the colors whose deviation between the density of the density detecting patch and the target value is greater than the threshold value. Therefore, in comparison with the configuration in which the image forming conditions for all the colors are repeatedly corrected, it is possible to decrease the time used for correction of the image forming condition and to decrease the amount of developers used for correction.

According to the second illustrative aspect of the invention, a preparation process to prepare for detection of the density by the density detecting unit is carried out before forming the density detecting patch. Therefore, it is possible to favorably detect the density of the density detecting patch.

According to the third illustrative aspect of the invention, a preparation process is carried out at a same time as cleaning of the corresponding density detecting patch after the density detecting patches for respective colors are formed. Therefore, in comparison with a case in which a preparation process and cleaning are carried out before and/or after each other, it is possible to shorten the time used from detection of the density of the last density detecting patch to detection of the density of the density detecting patch re-formed under the after-correction image forming condition. As a result, it is possible to further shorten the time used to correct the image forming condition.

According to the fourth illustrative aspect of the invention, in the preparation process, light is irradiated from the light emitting element to the surface of the base member on which the density detecting patch is formed, and light reflected from the surface of the base member is received by the light-receiving element. Then, the received light amount is detected. Therefore, various types of processes may be carried out by which favorable correction of the image forming condition can be achieved.

According to the fifth illustrative aspect of the invention, the light emitting amount from the light emitting element is adjusted based on the light receiving amount by the light receiving element. Therefore, when detecting the density of the density detecting patch, the light emitting element can be emitted at an appropriate light emitting amount. As a result, the density of the density detecting patch can be accurately detected. Finally, it is possible to accurately correct the image forming condition based on the detected density.

According to the sixth illustrative aspect of the invention, for example, when density detecting patches of a plurality of respective colors are formed, the density detecting patches of the respective patches are formed on a straight line with a fixed pitch while being arranged in a given order. In addition, when the density detecting patches of two or more colors selected from a plurality of colors (colors whose deviation between the density of the previously formed density detecting patch and the target density is greater than a threshold value) are formed, the density detecting patches of the selected colors are formed on a straight line with a fixed pitch, without securing any space capable of forming the density detecting patches of non-selected colors, while being arranged in the given order. Accordingly, it is possible to detect the densities of the density detecting patches of two or more selected colors by a single density detecting unit. As a result, the time used for correction of the image forming condition can be further shortened.

According to the seventh illustrative aspect of the invention, it is possible to decrease the time used to correct the developing bias and the amount of developers.

Exemplary Embodiments

Exemplary embodiments of the invention will now be described with reference to the drawings.

(Image Forming Apparatus)

Figure 1:
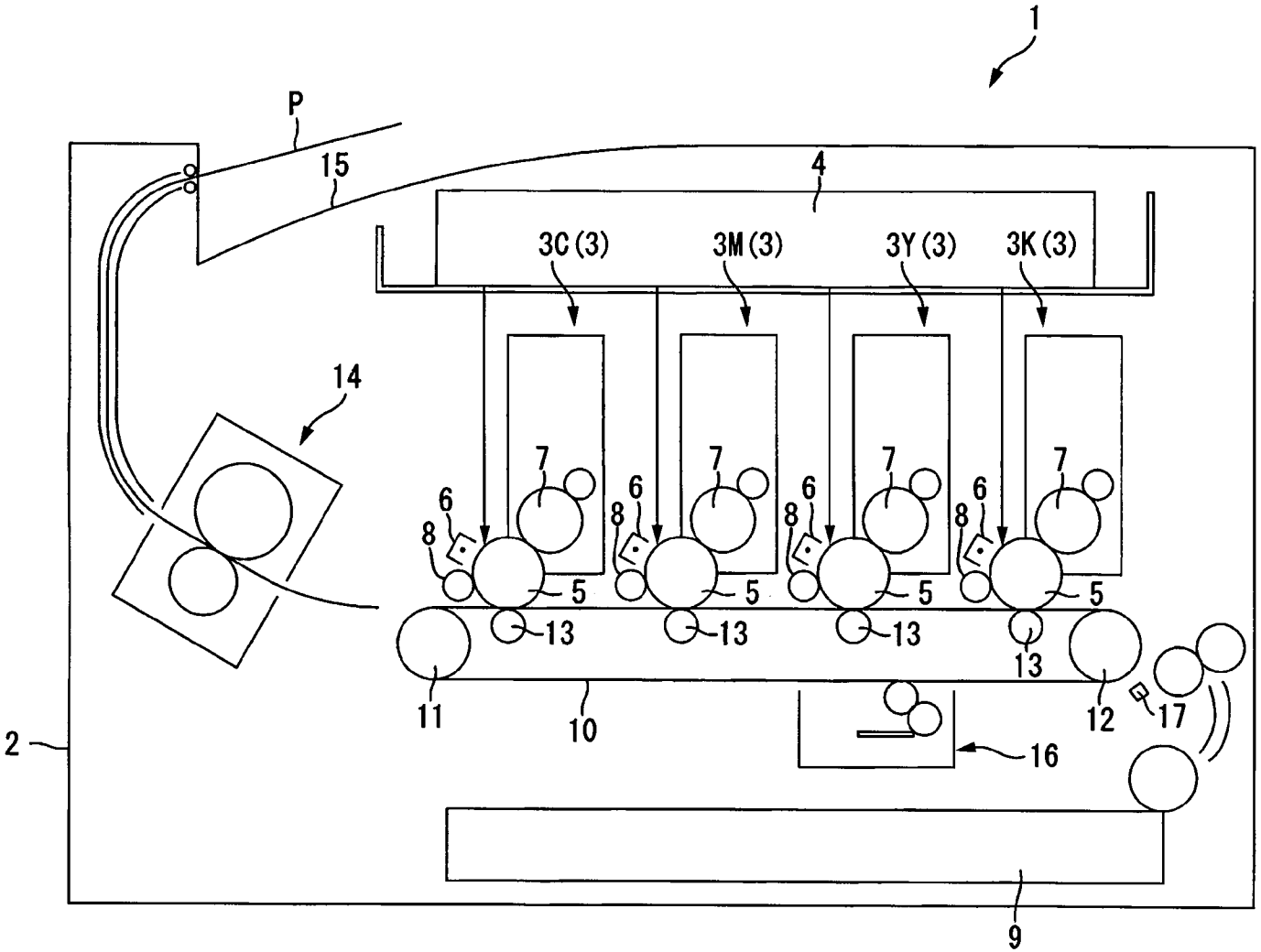
FIG. 1 is a side sectional view showing an image forming apparatus according to an exemplary embodiment of the invention.

Referring to FIG. 1, an image forming apparatus 1 includes a body casing 2. A tandem type color laser printer is one example of the image forming apparatus 1. In the body casing 2, a plurality of processing parts 3 is arranged in a row. In this exemplary embodiment, four processing parts 3 are arranged as one example of four image forming units. The processing parts 3 are provided so as to correspond to respective colors of black, yellow, magenta and cyan, and are designated as the black processing part 3K, the yellow processing part 3Y, the magenta processing part 3M, and the cyan processing part 3C. The black, yellow, magenta and cyan processing parts 3 are arranged in order in the conveyance direction of sheet P by a conveyor belt 10 described later. An exposure device 4 that emits four laser beams corresponding to the respective colors is disposed above the processing parts 3.

Each of the respective processing parts 3 includes a photosensitive drum 5 (one example of an image carrier), a scorotron type charger 6, a developing roller 7 (one example of a developing member) and a cleaning roller 8, respectively.

As the photosensitive drum 5 is rotated, the surface of the photosensitive drum 5 is selectively exposed by the laser beam from the exposure device 4 after the surface is uniformly electrified by the scorotron type charger 6. By the exposure, electric charge is selectively eliminated from the surface of the photosensitive drum 5, and an electrostatic latent image is formed on the surface of the photosensitive drum 5. A developing bias is applied to the developing roller 7. The electrostatic latent image is opposed to the developing roller 7 such that toner is supplied from the developing roller 7 to the electrostatic latent image by a potential difference between the electrostatic latent image and the developing roller 7. Therefore, a toner image is formed on the surface of the photosensitive drum 5.

Also, four LED arrays may be provided, instead of the exposure device 4, so as to correspond to the respective processing parts 3.

In addition, a sheet feeder cassette 9 in which sheets P are accommodated is disposed on the bottom part of the body casing 2. The sheets P accommodated in the sheet feeder cassette 9 are conveyed onto the conveyor belt 10. The conveyor belt 10 is one example of a base member. The conveyor belt 10 is provided over a driven roller 11 and a driven roller 12 and is disposed so as to be opposed to the four photosensitive drums 5. A plurality of transfer rollers 13, which correspond to the plurality of processing parts 3, are disposed at positions such that the rollers 13 are opposed to the respective photosensitive drums 5 with the conveyor belt 10 placed therebetween. Sheets P conveyed on the conveyor belt 10 pass one after another between the conveyor belt 10 and the respective photosensitive drums 5 by the running of the conveyor belt 10. Toner images on the surface of the photosensitive drums 5 are transferred onto the sheets P by transfer bias applied to the transfer rollers 13 when the toner images are opposed to the sheets P.

A fixing part 14 is provided at a downstream side in the conveyance direction of sheets P with respect to the conveyor belt 10. A sheet P on which the toner image is transferred is advanced to the fixing part 14. At the fixing part 14, the toner image is fixed on the sheet P by heating and compression. The sheet P having the toner image fixed thereon is delivered to a delivery tray 15 on the upper surface of the body casing 2.

A belt cleaner 16 is provided between the sheet feeding cassette 9 and the conveyor belt 10. Toner and paper dust adhered to the surface of the conveyor belt 10 are removed from the conveyor belt 10 by the belt cleaner 16. In addition, toner, which remains on the surface of the photosensitive drum 5 after the toner image is transferred onto the sheet P, is removed from the surface of the photosensitive drum 5 by the respective cleaning roller 8.

A density sensor 17 as one example of a density detecting unit for detecting the density of a patch Pt described later is disposed at a position (a position diagonally backward of the driven roller 12) opposed to the driven roller 12 with the conveyor belt 10 placed therebetween.

(Control System)

Figure 2:
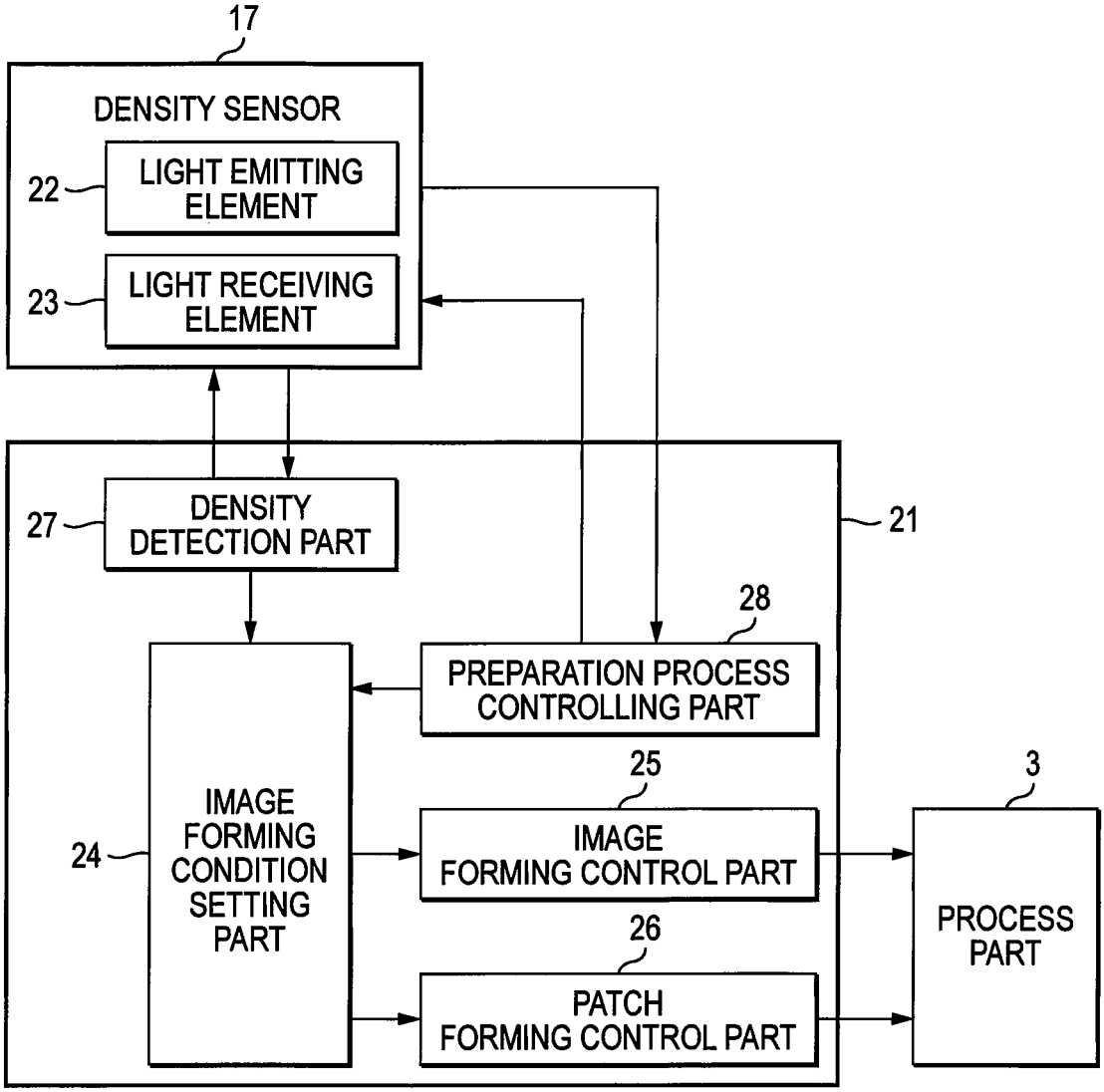
FIG. 2 is a block diagram showing a control system of the image forming apparatus of FIG. 1.

Referring to FIG. 2, the image forming apparatus 1 includes a microcomputer 21 including a CPU, a RAM, a ROM, etc.

The respective process parts 3 and a density sensor 17 are connected to the microcomputer 21. The density sensor 17 includes a light emitting element 22 such as a semiconductor laser, etc., and a light receiving element 23 for receiving laser beams which are emitted from the light emitting element 22 reflected by the surface of the patch Pt (described later) or the surface of the conveyor belt 10. The density sensor 17 outputs signals according to the amount of light received by the light receiving element 23 to the microcomputer 21.

The microcomputer 21 includes an image forming condition setting part 24 (one example of a condition correcting unit and a condition re-correcting unit) for setting various types of image forming conditions to form a toner image by the process parts 3; an image forming control part 25 that controls the process parts 3 based on the image forming conditions set by the image forming condition setting part 24 to form toner images corresponding to the image data input from outside; a patch forming control part 26 (one example of a patch forming unit and a patch re-forming unit) that controls the process parts 3 based on the image forming conditions set by the image forming condition setting parts 24 and forms a patch Pt used for correction of the image forming conditions on the conveyor belt 10; a density detecting part 27 that controls the density sensor 17 and detects the density of the patch Pt based on the signals input from the density sensor 17; and a preparation process controlling part 28 (one example of a preparation process unit and a preparation process re-executing unit) for executing preparation processes to prepare for detection of the density of the patch Pt based on the signals input from the density sensor 17. Any one of the image forming condition setting part 24, the image forming control part 25, the patch forming control part 26, the density detecting part 27 and the preparation process controlling part 28 may be a functional-processing part and may be implemented by software executed by the CPU.

(Development Bias Setting Process)

Figure 3:
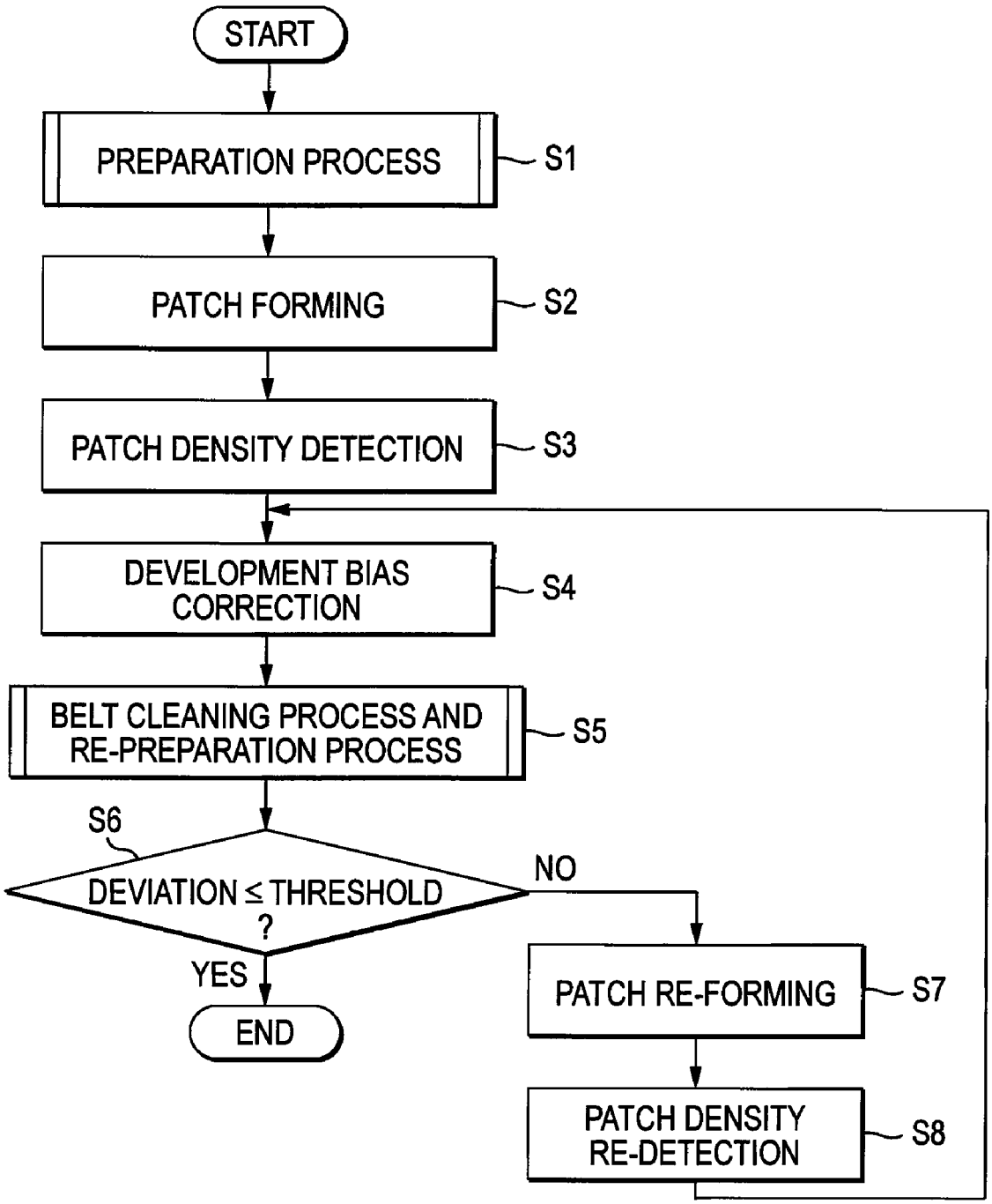
FIG. 3 is a flowchart showing a development bias setting process according to an exemplary embodiment of the invention.

FIG. 3 shows processing for the respective colors. In the following description, when referring to FIG. 3, it is assumed that the corresponding process is carried out for each of the colors.

The development bias setting process is a process to set development bias. The development bias is one example of the image forming condition. For example, the process is carried out whenever turning on the power of an image forming apparatus 1 or whenever a number of printed sheets reaches a certain number of sheets.

In the development bias setting process, first, a preparation process is carried out by the preparation process controlling part 28 (S1). In the preparation process, the light emitting element 22 of the density sensor 17 is controlled, and laser beams are irradiated to the positions where patches Pt of respective colors (Refer to FIG. 4) are to be formed on the conveyor belt 10, wherein laser beams reflected by the respective positions are received by the light receiving elements 23. The light-receiving amounts (i.e., the amounts of reflected light at the positions where the respective patches Pt are to be formed) received by the light receiving elements 23 are detected based on the signals input from the density sensor 17 (Light receiving amount detecting process). Further, the light emitting amounts (in detail, current applied to the light emitting elements 22) of the light emitting elements 22 to detect the densities of the patches Pt of the respective colors are established so that the respective detected light receiving amounts become fixed (Light amount adjusting process).

Figure 4:
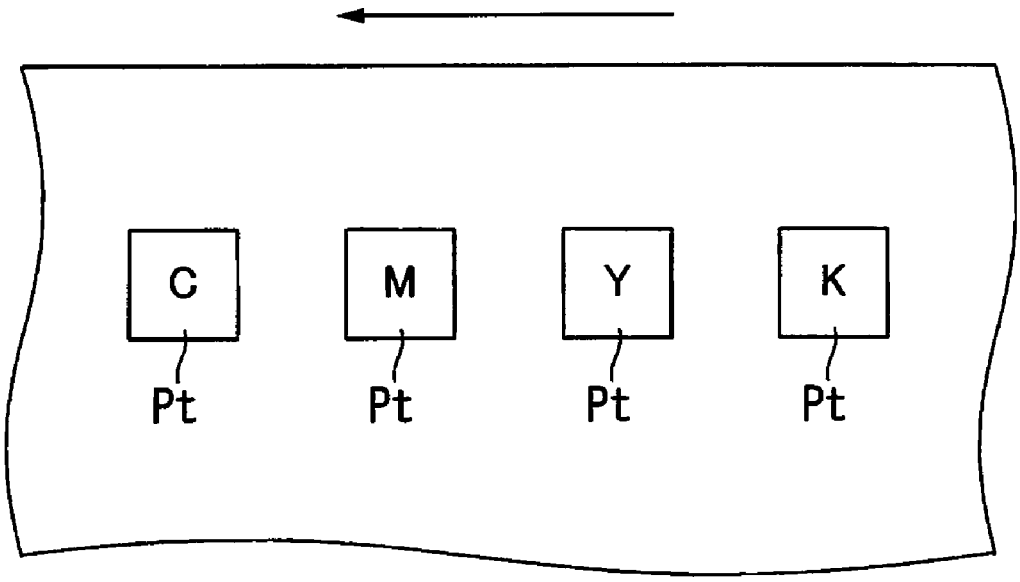
FIG. 4 is a schematic plan view showing patches of respective colors formed on a conveyor belt.

Next, development biases are set by the image forming condition setting part 24. That is, development biases Vs applied to the developing rollers 7 of the process parts 3 of the respective colors to form the patches Pt of respective colors are set by the image forming condition setting part 24. The development bias Vs is set for the respective colors. For example, the development bias Vs of black is set to 400V, the development bias Vs of yellow is set to 350V, the development bias Vs of magenta is set to 450V, and the development bias Vs of cyan is set to 420V. Then, the process parts 3 of the respective colors are controlled by the patch forming control part 26, and development biases Vs are applied to the developing rollers 7 of the process parts 3 of the respective colors. The toner image forming actions are simultaneously carried out by the process parts 3 of the respective colors and, as shown in FIG. 4, the patches Pt of the respective colors are formed on a straight line with a fixed pitch in order of black, yellow, magenta and cyan from the upstream side in the conveyance direction (i.e., the direction shown by the arrow in FIG. 4) of sheet P by the conveyor belt 10 (S2: Patch formation).

When the patches Pt of the respective colors are opposed to the density sensors 17 by running of the conveyor belt 10, the density sensors 17 are controlled by the density detecting part 27, and signals responsive to the amount of reflected light from the respective patches Pt are obtained from the density sensor 17. The densities Ds of the patches Pt of the respective colors are obtained by the density detecting part 27 based on the respective signals input from the density sensor 17 (S3: Patch density detection).

Continuously, the correction amounts Vt of the development biases of the respective colors are obtained by the image forming condition setting part 24 in accordance with the following expression based on deviations between the densities Ds of patches Pt of the respective colors and the target densities Dt for the respective colors.

$$Vt=(Dt-Ds)\times P \quad (1)$$

where P is a correction parameter for the respective color.

For example, where the densities Ds of the patches Pt of black, yellow magenta and cyan are, respectively 1.30, 1.24, 1.35 and 1.45, the target densities Dt of black, yellow magenta and cyan are, respectively, 1.50, 1.20, 1.50 and 1.50, and the correction parameters of black, yellow, magenta and cyan are, respectively, 400, 1000, 600 and 500, the correction amounts Vt of development biases of black, yellow, magenta and cyan may be obtained as shown below.

Development bias correction amount Vt of black= $(1.50-1.30)\times 400=80$

Development bias correction amount Vt of yellow= $(1.20-1.24)\times 1000=-40$

Development bias correction amount Vt of magenta= $(1.50-1.35)\times 600=90$

Development bias correction amount Vt of cyan= $(1.50-1.45)\times 500=25$

The development bias correction amount Vt for each of the respective colors is added to the development bias Vs for the respective color by the image forming condition setting part 24, wherein a new development bias Vb for the respective color is set. In other words, with respect to the respective colors, the development bias Vs is corrected to a new development bias Vb by the development bias correction amount Vt (S4: Development bias correction). For example, in the case of the above-described figures, the new development biases Vb of black, yellow, magenta and cyan are, respectively, set to 480, 310, 540 and 445V.

A belt cleaning process is carried out to remove the patches Pt of the respective colors from the conveyor belt 10. The belt cleaning process is achieved by removing the patches Pt of the respective colors from the conveyor belt 10 by the belt cleaner 16 when the patches Pt of the respective colors, which are formed on the conveyor belt 10 are opposed to the belt cleaner 16. On the other hand, a preparation process is carried out again by the preparation process controlling part 28 at a time of the belt cleaning process (S5: Belt cleaning process and re-preparation process).

After the new development biases Vb of the respective colors are set (regardless of whether or not the re-preparation process has been terminated), the patch forming control part 26 determines whether the deviations ΔD between the densities Ds of patches Pt of the respective colors and the target densities Dt for the respective colors are less than the thresholds Dth defined for the respective colors in advance (S6). With respect to a color for which it is determined that the deviation ΔD thereof is greater than the threshold Dth (hereinafter called a re-corrected color), the process part 3 of the re-corrected color is controlled, and a new development bias Vb is applied to the developing roller 7 of the process part of the re-corrected color. A toner image forming action is carried out by the process part 3 of the re-corrected color, wherein the patch Pt of the re-corrected color is formed on the conveyor belt 10 again (S7: Patch re-formation). At this time, patches Pt of re-corrected colors are arranged and formed on a straight line with a fixed pitch in order of black, yellow, magenta and cyan, but without leaving any blank space for patches Pt of colors other than the re-corrected colors.

Figure 5:
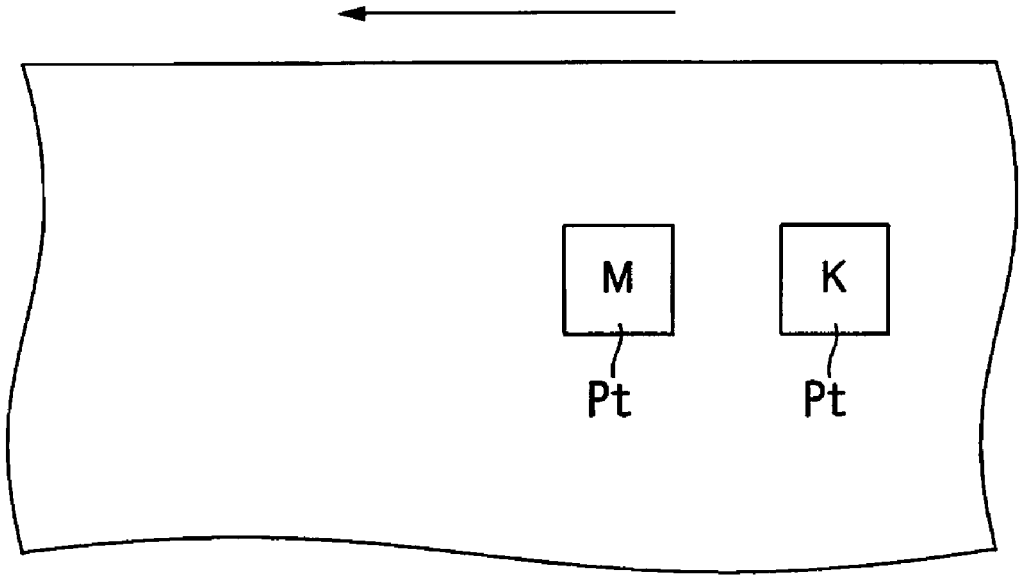
FIG. 5 is a schematic plan view showing patches re-formed on the conveyor belt.

For example, in the case of the above-described densities, the respective deviations ΔD between the densities Ds of patches Pt of black, yellow, magenta and cyan and the target densities Dt are, respectively, 0.2, 0.04, 0.15, and 0.05. Assuming the thresholds Dth of black, yellow, magenta and cyan are, respectively, 0.15, 0.05, 0.10 and 0.10, since the deviations ΔD of black and magenta are, respectively, greater than the respective thresholds Dth, patches Pt are re-formed with new development bias Vb only for black and magenta. At this time, the patch Pt is formed by the process part 3M of magenta with a delay of time necessary for the conveyor belt 10 to run only by the distance equivalent to the interval between the photosensitive drum 5 of the process part 3Y of yellow and the photosensitive drum 5 of the process part 3M of magenta from the time at which the patch Pt of black is formed by the process part 3K. Therefore, as shown in FIG. 5, patches Pt of black and magenta are arranged and formed on the conveyor belt 10 in order, but without leaving a blank space for yellow.

As the patches Pt of the respective re-corrected colors are opposed to the density sensor 17 by the running of the conveyor belt 10, the density sensor 17 is controlled by the density detection part 27, and signals responsive to the amount of reflected light from the patches Pt of the re-corrected colors are obtained from the density sensor 17. The densities Ds of the patches Pt of the respective re-corrected colors are obtained by the density detection part 27 based on respective signals input from the density sensor 17 (S8: Patch density re-detection).

The processes including and after S4 described above are carried out with respect to the re-corrected colors, and if the respective deviations ΔD between the density Ds of the patch Pt and the target density Dt is the threshold Dth or less for the respective colors (S6: YES), the development bias setting process is terminated. If the color has a greater deviation ΔD than the threshold Dth for the respective color (S6: NO), the processes including and after S7 are further carried out.

For example, in the case of the above-described figures, the patches Pt of black and magenta are re-formed, and where the densities of the patches Pt of black and magenta are, respectively, 1.54 and 1.52, the development bias correction amount Vt of black and magenta are, respectively, obtained to be −16V and −12V in accordance with the expression (1) described above. Accordingly, the new development biases Vb of black and magenta are, respectively, set (corrected) to 464 (=480−16) and 528 (=540−12). Since the deviations ΔD of the densities Ds of patches Pt of black and magenta and the target densities Dt are, respectively, 0.04 and 0.02, they are smaller than the respective thresholds Dth 0.15 and 0.10, respectively. Therefore, the development bias setting process is terminated.

As described above, patches Pt of respective colors are formed by development biases Vs set for the respective colors by the process parts 3 of the respective colors. Then, the densities Ds of the patches Pt of the respective colors are detected. The development biases Vs of the respective colors are corrected to new development biases Vb based on the respective deviations ΔD between the respective densities Ds and the target densities Dt for the respective colors. Where there exists any re-corrected color for which the deviation ΔD is greater than the threshold Dth, patch Pt is re-formed by the after-correction development bias Vb by the process part 3 of the re-corrected color. The development bias Vb of the re-corrected color is corrected again based on the deviation ΔD between the density Ds of the patch Pt of the re-corrected color and the target density Dt.

Thus, the development biases of all the colors are not repeatedly corrected, but the development biases only for re-corrected colors are re-corrected. Therefore, it is possible to reduce the time used for correction of the development biases and the quantity of toner in comparison with a configuration in which the development biases are repeatedly corrected for all the colors.

Also, a preparation process is carried out to prepare for detection of the density of patch Pt before forming the patch Pt. Accordingly, it is possible to favorably detect the density of the patch Pt.

Further, the second and subsequent preparation processes are carried out at the same time as a belt cleaning process. Therefore, in comparison with a case where the preparation process and belt cleaning process are carried out before and/or after each other, it is possible to shorten the time from the last detection of the density of patch Pt to detection of the density of patch Pt of a re-corrected color, which is formed by the post-correction development bias. As a result, further shortening of the time taken for correction of the development bias can be achieved.

In the preparation process, laser beams are irradiated from the light emitting element 22 to the surface of the conveyor belt 10, the light reflected from the surface of the conveyor belt 10 is received by the light receiving element 23, and the light-receiving amount is detected. Therefore, based on the light receiving amount, it is possible to determine, for example, whether toner remains on the surface of the conveyor belt 10. If toner remains on the surface of the conveyor belt 10, the conveyor belt 10 is caused to run one cycle or more, and patches Pt are formed after the conveyor belt 10 is cleaned by the belt cleaner 16. As a result, high quality patches Pt can be formed, and it is possible to correct the development biases based on the densities Ds.

Also, in the preparation process, the light emitting amount from the light emitting element 22 is adjusted based on the light receiving amount at the light receiving element 23. Therefore, the light emitting element 22 is caused to emit light at a proper light emitting amount when detecting the densities of the patches Pt. As a result, the densities Ds of the patches Pt can be accurately detected. Furthermore, the development biases can be favorably corrected based on the densities Ds.

In addition, patches Pt of re-corrected colors are arranged and formed on a straight line with a fixed pitch in order of black, yellow, magenta and cyan, without leaving any empty space for patches Pt of colors other than the re-corrected colors. Therefore, it is possible to detect the densities of patches Pt of two or more re-corrected colors in a shorter period of time. As a result, the time taken for correction of the development biases can be further shortened.

Modification to Exemplary Embodiments

The above-described exemplary embodiments of the invention have been described in relation to a tandem type color laser printer. Alternatively, the invention may be applied to other printers.

For example, the present inventive concept may be applied to an intermediate transfer type color printer in which toner images of respective colors are transferred from respective image carriers to an intermediate transfer belt, and thereafter are collectively transferred from the intermediate transfer belt to a sheet.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a plurality of image forming units, one image forming unit being provided for each of a plurality of colors, and forming an image of the respective corresponding color;

a density detecting unit configured to detect a density of density detecting patches;

a processor;

memory having executable instructions stored thereon that, when executed by the processing unit, cause the processor to operate as a patch forming unit, which actuates the respective image forming units according to image forming conditions for the respective colors of the image forming units to form the density detection patches of the respective colors;

a condition correcting unit that controls the density detecting unit to detect the density of the density detecting patches of the respective colors, and corrects the image forming conditions based on respective deviations between the detected densities of the density detecting patches of the respective colors and target densities defined for each of the colors;

a patch re-forming unit that, for each color for which the respective deviation is greater than a threshold value, actuates the image forming unit corresponding to the color so as to generate a re-formed density detecting patch of the color using the respective image forming condition previously corrected by the condition correcting unit;

a condition re-correcting unit that is configured to control the density detecting unit to detect a density of the re-formed density detecting patch and re-correct the respective image forming condition of the color of the re-formed density detecting patch based on a deviation between the density of the re-formed density detecting patch and the target density of the color corresponding to the re-formed density detecting patch;

a preparation process unit that executes a preparation process to prepare for detection of the density by the density detecting unit before the density detecting patch is formed by the patch forming unit; and a preparation process re-executing unit that re-executes the preparation process before the re-formed density detecting patch is generated by the patch re-forming unit; and a cleaning unit that cleans the density detecting patch formed by the patch forming unit, wherein the preparation process re-executing unit executes the preparation process at a same time that the density detecting patch is cleaned by the cleaning unit.

2. The image forming apparatus according to claim 1, wherein the patch forming unit forms the density detecting patches of the respective colors in a straight line with a fixed pitch while being arranged in a given order, and wherein the patch re-forming unit generates the re-formed density detecting patches in a straight line with a fixed pitch while being arranged in the given order.

3. The image forming apparatus according to claim 1, wherein each of the image forming units comprises:

an image carrier on which an electrostatic latent image is formed; and a developing member, to which development bias is applied, and which supplies developer to the image carrier according to the development bias, wherein the image forming condition of the respective image forming unit is the development bias.

4. The image forming apparatus according to claim 1, further comprising:

a base member, on which the density detecting patches are formed, wherein the density detecting unit comprises:

a light emitting element; and a light receiving element that receives light, which is emitted from the light emitting element and is reflected from a surface of the density detecting patch or a surface of the base member, and wherein the preparation process comprises:

receiving the light reflected from the surface of the density detecting patch or the surface of the base member by the light receiving element; and detecting an amount of the received light.

5. The image forming apparatus according to claim 4, wherein the preparation process further comprises:

a light amount adjustment process comprising adjusting an amount of the light emitted from the light emitting element so that the amount of the detected light becomes constant.

6. An image forming apparatus comprising:

a plurality of image forming units, each of which forms an image in a respective one of a plurality of colors;

a density sensor;

a processor;

memory having executable instructions stored thereon that, when executed by the processing unit, cause the processor to operate as a patch forming unit, which individually controls each of the image forming units according to an image forming condition associated with the respective color of the respective image forming unit to form a patch of the respective color;

a condition setting unit that controls the density sensor to detect the density of a patch, calculates a deviation between the detected density of the patch and a target density defined for the respective color, and corrects the image forming condition associated with the color of the patch based on the calculated deviation;

a controller that controls the patch forming unit to generate a patch for each of the plurality of colors and controls the condition setting unit to detect the densities of the respective patches, calculate the respective deviations, and to correct the respective image forming conditions associated with each of the plurality of colors, and for each color for which the respective deviation is greater than a threshold value associated with the respective color, controls the patch forming unit to regenerate the patch for the color using the corrected image forming condition, and controls the condition setting unit to detect the density of the regenerated patch, recalculate the deviation, and re-correct the image forming condition associated with the color of the regenerated patch; and a preparation process unit that executes a preparation process to prepare for detection of the density by the density sensor before the patch is formed by the patch forming unit, wherein the controller controls the preparation process unit to re-execute the preparation process before the patch is regenerated by the patch forming unit; and a cleaning unit that cleans the patch formed by the patch forming unit, wherein the preparation process unit re-executes the preparation process at a same time that the patch is cleaned by the cleaning unit.

7. The image forming apparatus according to claim 6, wherein the patch forming unit generates the patches for each of the plurality of colors in a straight line with a fixed pitch while being arranged in a given order.

8. The image forming apparatus according to claim 6, further comprising a conveyor belt, on which the patches are formed.

9. A method for adjusting color densities in an image forming apparatus comprising a density sensor and a plurality of image forming units, each image forming unit being associated with a respective one of a plurality of colors, the method comprising:

individually controlling each of the image forming units according to an image forming condition associated with the respective color of the respective image forming unit to form a patch of each of the plurality of colors;

detecting a density of each of the patches;

calculating a deviation between the detected density of each of the patches and a target density defined for the respective color;

correcting the respective image forming conditions associated with each of the plurality of colors based on the calculated deviations;

comparing the respective deviation for each color with a threshold deviation associated with the color;

for each color for which the respective deviation is greater than the threshold deviation, regenerating the patch for the color using the corrected image forming condition;

detecting a density of the regenerated patch;

calculating a second deviation between the density of the regenerated patch and the target density associated with the color; and re-correcting the image forming condition associated with the color based on the calculated second deviation;

executing a preparation process unit to prepare for detection of the density before the patch is formed by the image forming unit;

re-executing the preparation process before the patch is regenerated by the image forming unit; and cleaning the patch formed by the image forming unit, wherein the preparation process is executed at a same time that the patch is cleaned.

* * * * *